US007124787B2

(12) United States Patent
Lueschen

(10) Patent No.: US 7,124,787 B2
(45) Date of Patent: Oct. 24, 2006

(54) PNEUMATIC CABLE TIE INSTALLATION TOOL

(75) Inventor: William K. Lueschen, Cedarburg, WI (US)

(73) Assignee: HellermannTyton Corporation, Milwaukee, WI (US)

( * ) Notice: Subject to any disclaimer, the term of this patent is extended or adjusted under 35 U.S.C. 154(b) by 176 days.

(21) Appl. No.: 10/921,089

(22) Filed: Aug. 18, 2004

(65) Prior Publication Data

US 2006/0037661 A1 Feb. 23, 2006

(51) Int. Cl.
*B21F 9/02* (2006.01)

(52) U.S. Cl. ..... 140/123.6; 140/93.2

(58) Field of Classification Search ..... 140/93.2, 140/93, 123.6; 16/445; 248/685, 691, 692, 248/689, 181.1

See application file for complete search history.

(56) References Cited

U.S. PATENT DOCUMENTS

| | | | | |
|---|---|---|---|---|
| 2,510,812 | A * | 6/1950 | Garland et al. | 248/685 |
| 2,593,789 | A * | 4/1952 | Pearson | 211/85.7 |
| 2,713,279 | A | 7/1955 | Harris | |
| 3,130,765 | A | 4/1964 | Neuschotz | |
| 3,168,119 | A | 2/1965 | Schwester et al. | |
| 3,254,680 | A | 6/1966 | Caveney et al. | |
| 3,284,076 | A | 11/1966 | Gibson | |
| 3,332,454 | A | 7/1967 | Lawson et al. | |
| 3,344,815 | A | 10/1967 | Lawson et al. | |
| RE26,492 | E | 11/1968 | Caveney et al. | |
| 3,589,406 | A | 6/1971 | Moberg | |
| 3,610,296 | A | 10/1971 | Kabel | |
| 3,645,302 | A | 2/1972 | Caveney et al. | |
| 3,661,187 | A | 5/1972 | Caveney et al. | |
| 3,712,346 | A | 1/1973 | Noorily | |
| 3,735,784 | A | 5/1973 | Obuch et al. | |
| 3,752,199 | A | 8/1973 | Fekete | |
| 3,782,426 | A | 1/1974 | Morgan et al. | |
| 3,830,263 | A | 8/1974 | Benfer | |
| 3,845,554 | A | 11/1974 | Joanis et al. | |
| 3,853,155 | A | 12/1974 | Kabel | |
| 3,865,156 | A | 2/1975 | Moody et al. | |
| 3,931,838 | A | 1/1976 | Bakermans | |
| 3,993,109 | A | 11/1976 | Fortsch | |
| 4,064,918 | A | 12/1977 | Pobuta et al. | |
| 4,081,002 | A | 3/1978 | Violi | |
| 4,093,005 | A | 6/1978 | Eberhardt et al. | |
| 4,129,157 | A | 12/1978 | Sciolotto | |
| RE29,973 | E | 4/1979 | Paradis | |
| 4,192,358 | A | 3/1980 | Bone | |
| 4,252,158 | A | 2/1981 | McDade | |

(Continued)

*Primary Examiner*—Dmitry Suhol
(74) *Attorney, Agent, or Firm*—Ryan Kromholz & Manion, S.C.

(57) ABSTRACT

An improved tool for tensioning and severing a cable tie used in connection with a remote pneumatic power supply is disclosed. The tool comprises a housing having a gripping portion and a barrel portion, with barrel portion having a front section and a rear section. A nosepiece is located on the front section of the barrel portion, and the nosepiece has a cable tie entrance having a lower edge and an upper edge having a predetermined sharpness that assists in severing a cable tie. A blade located in the nosepiece cooperates with the sharpened edge to sever the cable tie. The cable tie tensioning tool may have an overhead or underside fitting for communication with the pneumatic power supply. An improved hook that interacts with a spring-loaded pin helps in hanging an orientating the tool. An oversized flange located on the nosepiece assists in feeding a cable tie into the tool.

5 Claims, 7 Drawing Sheets

U.S. PATENT DOCUMENTS

| | | | | |
|---|---|---|---|---|
| RE30,996 | E | 7/1982 | Pobuta et al. | |
| 4,390,047 | A | 6/1983 | Kaneko | |
| 4,410,019 | A | 10/1983 | Suzuki | |
| 4,449,429 | A | 5/1984 | Sauer et al. | |
| 4,498,506 | A * | 2/1985 | Moody et al. | 140/93.2 |
| 4,499,928 | A | 2/1985 | Furutsu | |
| 4,548,242 | A | 10/1985 | Paradis | |
| 4,793,385 | A | 12/1988 | Dyer et al. | |
| 4,862,928 | A * | 9/1989 | Caveney et al. | 140/93.2 |
| 4,997,011 | A | 3/1991 | Dyer et al. | |
| 5,492,156 | A | 2/1996 | Dyer et al. | |
| 5,769,133 | A * | 6/1998 | Dyer et al. | 140/123.6 |
| 5,921,290 | A | 7/1999 | Dyer et al. | |
| 6,840,289 | B1 * | 1/2005 | Hillegonds | 140/93.2 |
| 2004/0187949 | A1 * | 9/2004 | Lenzen | 140/93.2 |

* cited by examiner

PNEUMATIC CABLE TIE INSTALLATION TOOL

BACKGROUND OF THE INVENTION

The present invention relates generally to tools for installing cable ties and, more particularly, to handheld pneumatic tools that provide tension to the cable ties and cut off excess portions of the ties while under tension.

Flexible cable ties and tools for installing flexible cable ties are well known. Cable ties are used to bundle and secure wires, cables, and tubes, and similar items. As an example, cable ties may be used on an automobile assembly line to secure fluid and electrical lines to a vehicles chassis. Generally, installation tools are designed so that the cable ties will bundle such items in a tight, secure bundle. Typically, flexible cable ties include a head portion and a tail portion extending from the head. The tail is looped around the items to be secured and passed through the head portion. A locking or ratcheting mechanism in the head holds the tail in place and secures the tie around the bundled items. Once a predetermined tension has been reached, the excess portion of the tie is clipped near the head portion.

A variety of tools have been developed to enable workers to install flexible cable ties quickly, efficiently, and uniformly. These tools generally grip the tail portion of the tie after the tie has been looped around a bundle and the tail is passed through the head portion of the tie. The tool uses a pawl or similar device to grip and tension the tie to a predetermined tension, and a blade will sever the excess portion of the tail, thereby providing a tidy bundle of items.

Specifically, various handheld tools have been developed to assist in the installation of cable ties. Commonly, these devices have a pistol or gun-like shape, with a squeezable trigger that allows the tail to be pulled until a predetermined tension is achieved, after which a cutting blade adjacent the nose of the tool cuts off the excess portion of the tie. An example of such a tool may be found in Dyer et al., U.S. Pat. No. 5,921,290. The tension at which cutoff occurs may be adjusted by the operator. Such tools may be manually operated, or powered in other ways, such as pneumatically.

There have been improvements in these handheld tools. For instance, Hillegonds, U.S. Pat. Appl. No. 2004/0079436, describes a pneumatic cable tie tools for delivering a more uniform tensioning arrangement. Nilsson et al., U.S. Pat. No. 5,915,425, also describes a handheld tool that allows the operator to more accurately adjust the tension on the tool. Dyer et al., U.S. Pat. No. 5,769,133, describes a lightweight cable tie-tensioning tool that is remotely powered.

However, cable tie tools may still be improved. For instance, it would be advantageous to have a tool that will be easily adaptable and usable in different settings, rather than trying to adapt environment or surroundings of the tool for specific tool arrangements. One assembly line is not necessarily uniform with another assembly line. For example, pneumatic supply hoses may not be located at the same level or place on different assembly lines. Some supply hoses may hang down from a ceiling, while others may come up from the floor or be located at ground level. There exists a need for a tool that would adapt to different arrangements.

Also, there exists a need for a more facile cutting and feeding process of the cable ties into these handheld tools. Proper alignment of a cable tie before severing can expedite the severing process, and a more efficient cutting blade or blades would also improve the overall process. Thus, an improved device is contemplated.

SUMMARY OF THE INVENTION

The present invention provides a tool for installing cable ties. The tool has a pistol-shaped housing that includes a grip, a barrel portion, a nosepiece portion, and a trigger located on the housing. A tensioning mechanism responds to the trigger to provide tension for the cable tie, and a cutoff mechanism severs the cable tie when the tie reaches a predetermined tension. The cutoff mechanism comprises two separate blades for severing the cable tie.

The housing of the tool can be arranged with also two separate valve fittings, one located on the bottom of the housing and one located on the top of the housing, so that the tool can receive pneumatic power from supply lines located at different places and different orientations, while still being easily operated by an individual. Along with separate valve fittings, the tool also has an improved hanging device or hook that can be locked in place by use of a spring-loaded pin, which allows unencumbered storage of the tool when not in use.

The nosepiece section, which receives a cable tie into the tool, has a reinforced ledge that helps funnel the cable tie into the tensioning mechanism. The tensioning mechanism has a pawl member that has an oversized flange that further assists in feeding the cable tie into the tool.

These and other advantages of the present invention will be further exemplified with the following drawings and description.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
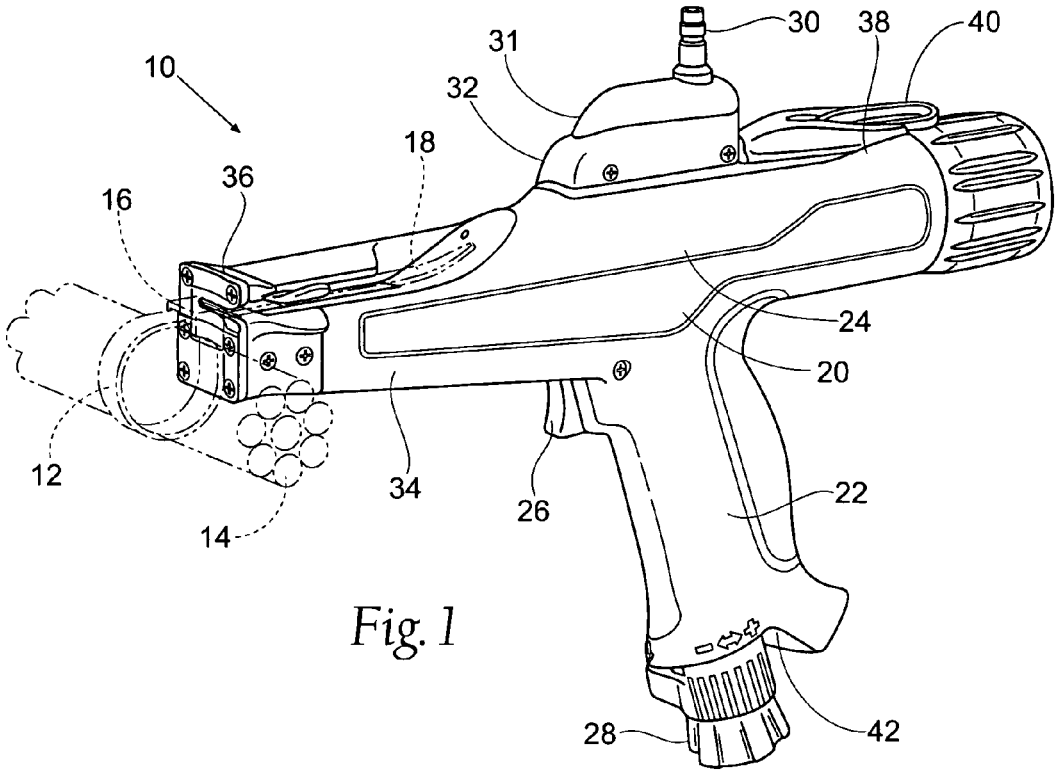
FIG. 1 is a perspective view of a cable tie-tensioning tool according to the present invention having a top pneumatic supply feed.

A power assisted cable tie-tensioning tool 10 is shown in FIG. 1. The tool 10 is typically used to install flexible cable ties 12 (shown in phantom) around wire cables or bundles 14 (also shown in phantom). As illustrated, the cable tie 12 includes a head portion 16 and a tail portion 18. The tool 10 grips the tail portion 18 and pulls it through the head 16. Once a predetermined tension is achieved, the tool 10 cuts off the excess tail portion 18 closely adjacent the head portion 16.

Still referring to FIG. 1, the cable tool 10 has a generally gun or pistol shaped housing 20 having a grip or handle portion 22 and a barrel portion 24. A trigger 26 and tension control means 28 are located on the handle portion 22. A pneumatic valve fitting 30 located on a hood section 31 of the top side 32 of the barrel portion 24 allows the tool to be supplied with power from a hose and pneumatic power supply (not shown) that may hang down from a ceiling or elevated surface. The top side 32 location and arrangement of the pneumatic valve fitting 30 is unique and different from previous tool arrangements, which allows the tool 10 to be used from overhead hose and power supply arrangements in a more ergonomically suitable manner than previous cable tie tools. This arrangement also prevents the kinking or severe bending of the pneumatic hose when the hose originates on a side of the tool opposite the fitting.

The front section 34 of the barrel portion 24 comprises a nosepiece 36, which will be discussed in greater detail with regard to FIGS. 7–10. The rear section 38 of the barrel portion 24 houses a hanging hook 40, which will also be discussed in greater detail with regard to FIGS. 11–12.

Figure 2:
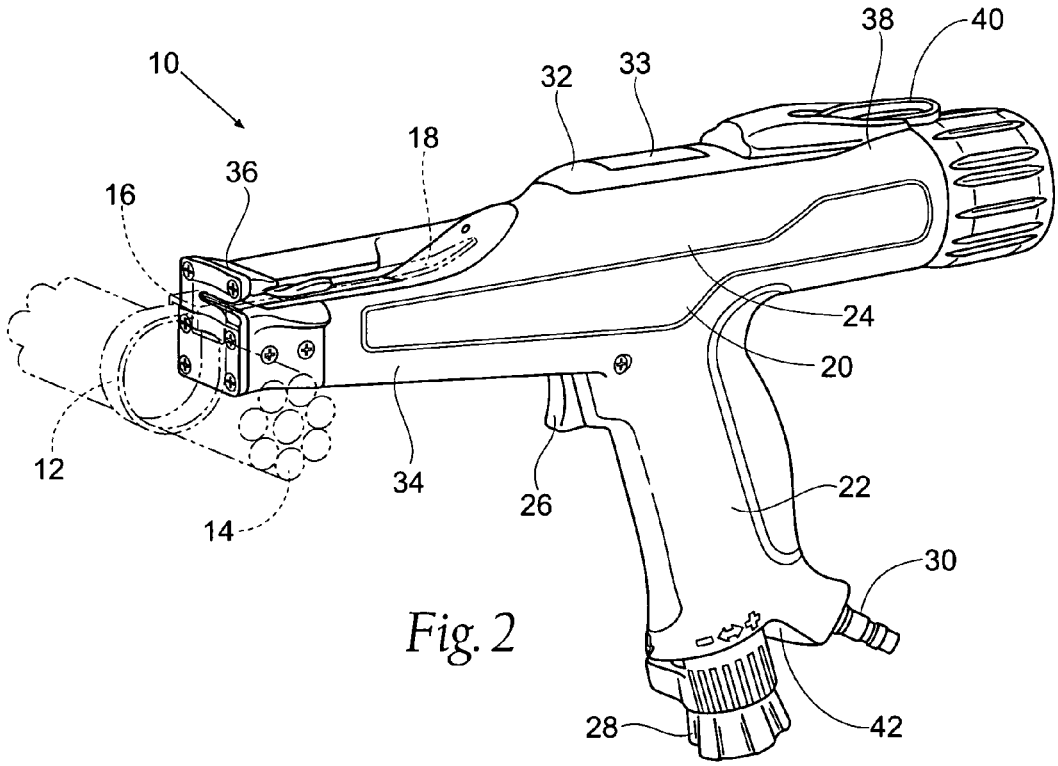
FIG. 2 is a perspective view of a cable tie-tensioning tool according to the present invention having a bottom pneumatic supply feed.

FIG. 2 shows a second embodiment of the cable tool 10 according to the present invention. The tool 10 is similar to that shown in FIG. 1 except that the valve fitting 30 is located on the bottom side 42 of the grip portion 22. The arrangement of FIG. 2 allows for the tool to be used in connection with a power supply and hose that is located on or near a floor or lower surface from where the tool is being operated. The barrel portion 24 is arranged so that the tension control means 28 and the pneumatic valve 30 are spaced far enough apart to allow the tension control means 28 to be adjusted without interference from a hose that would be attached to the pneumatic valve 30. The shown arrangement allows for a larger tension control means 28 than previous designs, which provides for more precise and sensitive control of the amount of tension delivered to the tool 10.

Figure 3:
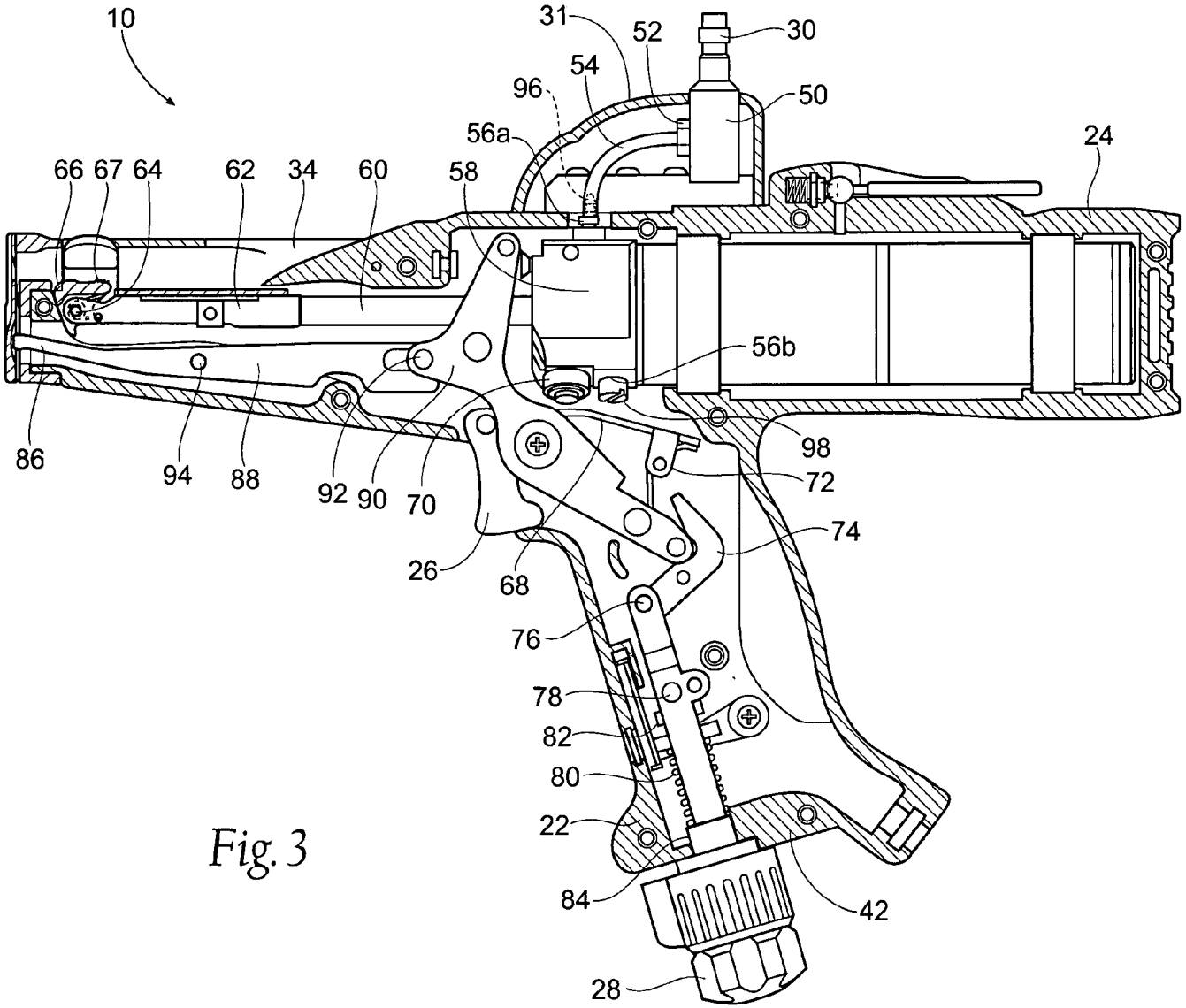
FIG. 3 is a sectional front view of the embodiment of FIG. 1.

FIG. 3 shows a cut-away side view of the cable tool 10 having an overhead air supply as shown in FIG. 1. The valve fitting 30 is connected to a valve 50 having an outlet 52, which allows a supply hose 54 to be attached to the valve 50. The supply hose 54 is further attached to an inlet 56 located on an air cylinder 58. Thus, an air supply is delivered from an external supply source to the tool 10. When activated by the trigger 26, the air supply will provide movement to a piston (not shown) located within the air cylinder 58. The piston is connected to a tension rod 60, which in turn is connected to a tensioning mechanism 62. The tensioning mechanism 62 is attached to a linkage 64, which is connected to a gripping mechanism 66. The surface of the gripping mechanism 66 preferably comprises a pawl or pawl-like structure 67, which allows the gripping mechanism 66 to more easily engage a cable tie. As the tensioning mechanism 62 and the tensioning rod 60 are pulled inwardly of the air cylinder 58, the gripping mechanism 66 also retracts. The gripping mechanism 58 engages the tail portion 18 of the cable tie 12 (not shown), and the tail portion is pulled rearward until a predetermined tension is reached.

Still referring to FIG. 3, when the trigger 26 is depressed, a trigger lever 68 attached to the trigger 26 will move upwardly and contact an actuating valve 70 located on the air cylinder 58. The actuating valve 70 activates air cylinder 58, to provide the movement of the air cylinder 58, described above. When the trigger is released, the trigger lever 68 moves away from the actuating valve 70, thereby deactivating movement of the air cylinder 58.

The trigger lever 68 is also attached to a spring 72, preferably a leaf spring 72. The leaf spring 72 is arranged to contact a tension linkage 74, which is connected to a tension pin 76 that is connected to a U-bracket 78. The tension pin 76 allows the tension linkage and the U-bracket 78 to be pivotally connected to one another. The bottom end of the U-bracket 78 is biased toward the bottom end 42 of the grip portion 22 by a tension spring 80. The tension spring 80 sits between a tension nut 82 and a fixed nut 84, and the tension spring 80 is slidably movable along the arms of the U-bracket 78. The tension control 28 is coupled to a threaded tension rod that threadedly engages the tension nut 82. As the tension control 28 is turned, the tension rod will draw the tension nut 82 closer to the fixed cam 84 or drive the tension nut 82 away from the fixed cam 84, depending on the direction the tension control 28 is turned. Accordingly, tension is applied and adjusted for the U-bracket 78 and onward to the tension linkage 74, which provide tension for a cutoff mechanism 86.

The cutoff mechanism 86 provides movement to sever the cable tie 12 when movement of the trigger 26 activates the tool 10. A blade link 88 is pivotally attached to a centrally located main link 90 by way of a horizontal pivot axis 92. Opposite of where the main link 90 is connected to the blade link 88, the main link 90 is in pivotal contact with the tension linkage 74, thereby providing the necessary tension to the cutoff mechanism 86. The blade link 88 comprises an elongate, rigid lever that extends generally the length of the front section 34 of the barrel portion 24 of the tool 10. The blade link 88 is pivotally mounted to the housing 20 around a substantially horizontal blade link axis 94. The front of the blade link 88 sits within the nosepiece 36, and will be described in more detail with respect to FIGS. 9 and 10.

Figure 4:
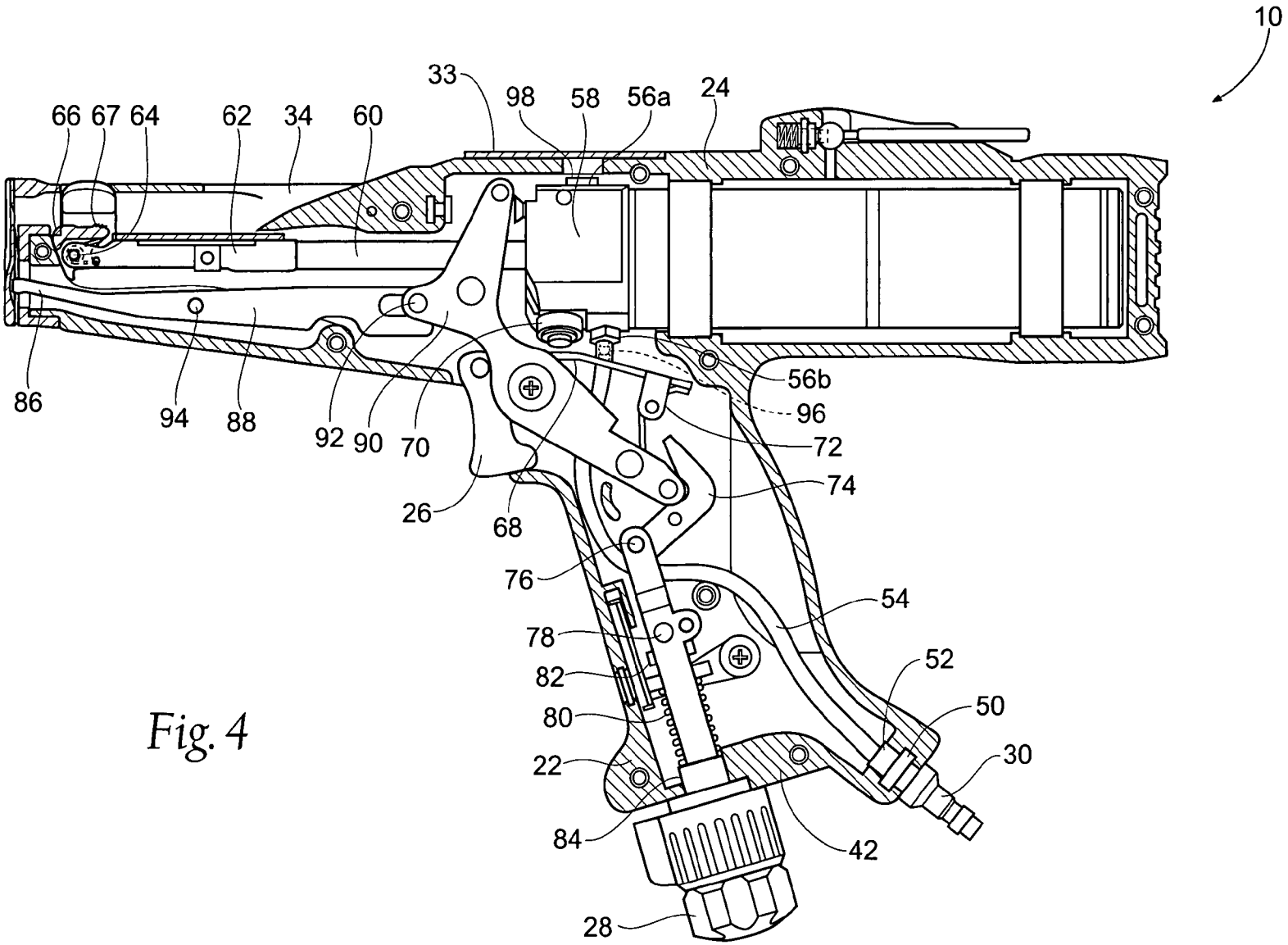
FIG. 4 is a sectional front view of the embodiment of FIG. 2.

FIG. 4 shows a cut-away side view of the cable tool 10 having a bottom air supply as shown in FIG. 2. The cable tool 10 is arranged similar to the arrangement of FIG. 3, except the positioning of the fitting 30, valve 50, and supply hose 54 are now located in the grip portion 22 of the tool 10. The supply hose 54 is inserted into an inlet **56*b*. The rear of the grip portion 22 is also extended away from the tension control 28, to prevent interference of an air hose (not shown) and the gripper portion 22 with the tension control. As previously stated, the spaced apart grip portion 22 allows for a more sensitive tension control 28 to be used. FIG. 4 also replaces the hood 31 with a plate 33 to cover where the fitting 30 of FIG. 3 was located. The plate 33 may be removable, thereby providing a potential conversion of the tool 10** from a bottom air supply to an overhead air supply, even post-production.

FIG. 4 shows the novel adaptability of the present invention, in that minimal reconfiguration is necessary to adjust the tool from an overhead to a bottom supply system. A plug 98 is shown in both FIGS. 3 and 4. In FIG. 3, the plug 98 is located in the inlet **56*b* located on the bottom side of the air cylinder 58, and in FIG. 4 the plug 98 is located in the inlet 56*a* located on top side of the air cylinder 58. A cylinder nozzle or fitting 96 (See FIGS. 5 and 6) will be inserted into the inlet, either 56***a* or 56*b*, that does not contain the plug 98, and the inlet hose 54 will be attached to the nozzle 96. Accordingly, conversion from an overhead feed cylinder to a bottom feed cylinder simply requires rearrangement of the plug 98 and the nozzle 96/inlet hose 54.

Figure 5:
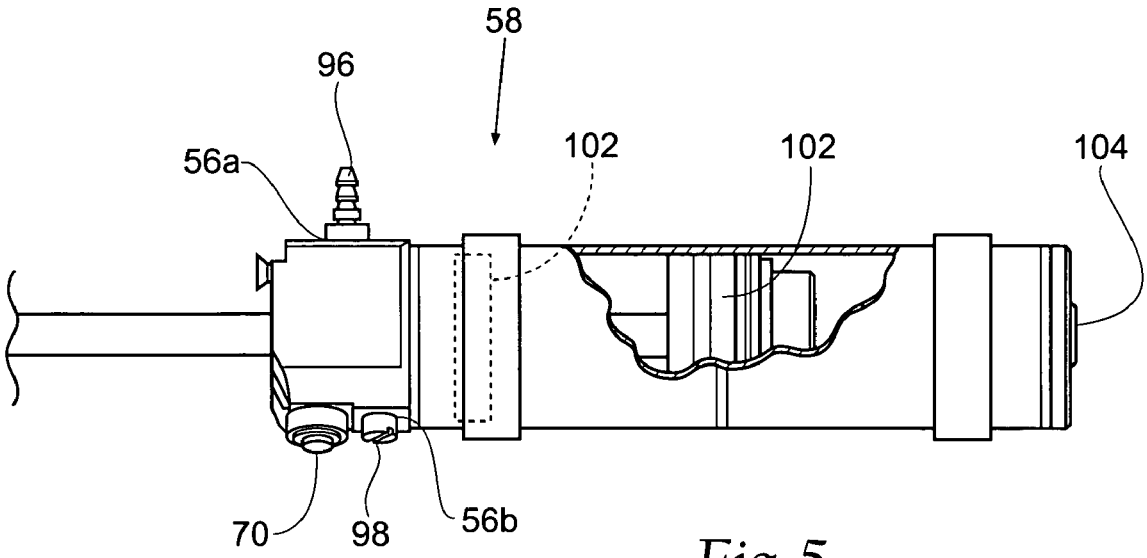
FIG. 5 is a partially cut-away front view of a cylinder used in the embodiment according to FIG. 1.
Figure 6:
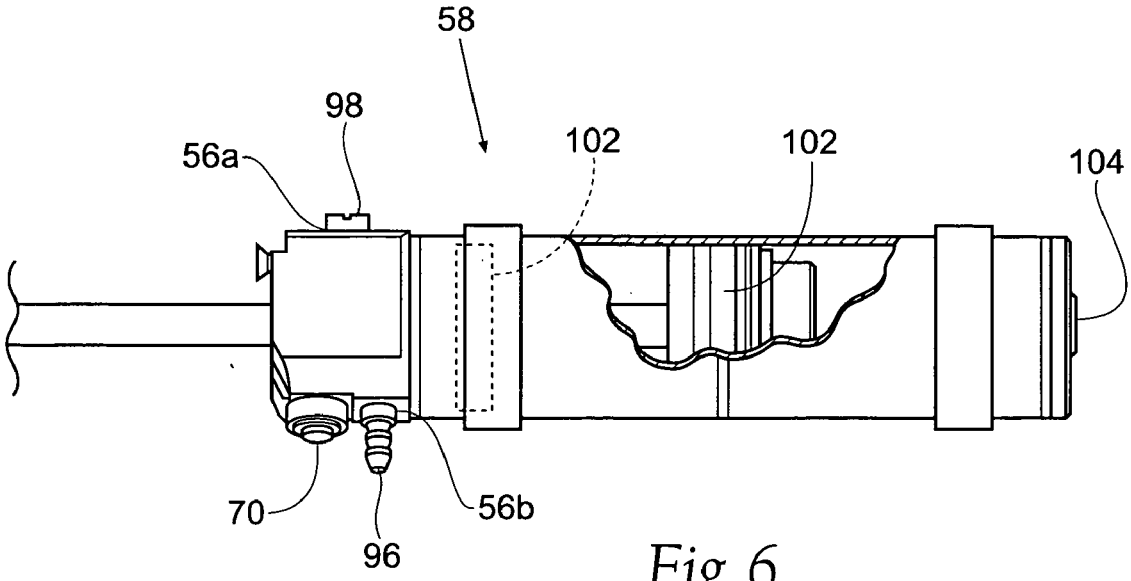
FIG. 6 is a partially cut-away front view of a cylinder used in the embodiment according to FIG. 2.

FIGS. 5 and 6 show partially cut-away front views of the air cylinder 58 used in the present invention. FIG. 5 depicts the air cylinder 58 used in relation to the embodiment of FIG. 1, and FIG. 6 depicts the air cylinder 58 used in relation to the embodiment of FIG. 2. The design of the cylinder 58 allows the same cylinder to be used for either a top supply feed or a bottom supply feed. A cylinder nozzle 96 and a plug 98 are located within the inlets 56*a* and 56*b* within the cylinder 58. The cylinder nozzle 96 provides attachment for the supply hose 54 (see FIGS. 3 and 4). The inlets 56*a* and 56*b* are designed alike to receive either the nozzle 96 or the plug 98. Thus, changing the cable tool from an overhead to bottom supply tool merely requires changing the positioning of the nozzle 96 and the plug 98, which significantly increases the utility of the present invention over prior designs.

Still referring to FIGS. 5 and 6, the cylinder 58 is shown partially cut-away. The cylinder 58 houses a pair of pistons 102. A pressure release 104 may be located on the rear of the cylinder 58. The pistons 102 are arranged in tandem, or arranged in a series, which reduces the diameter of the cylinder 58 and increases the length of the cylinder 58. Because of the reduced diameter of the cylinder 58, the present tool 10 is more easily held by an operator and is more user friendly than previous cable tie tool designs. The operator will be able to move and control the cable tie tool 10 more efficiently than prior tools.

Figure 7:
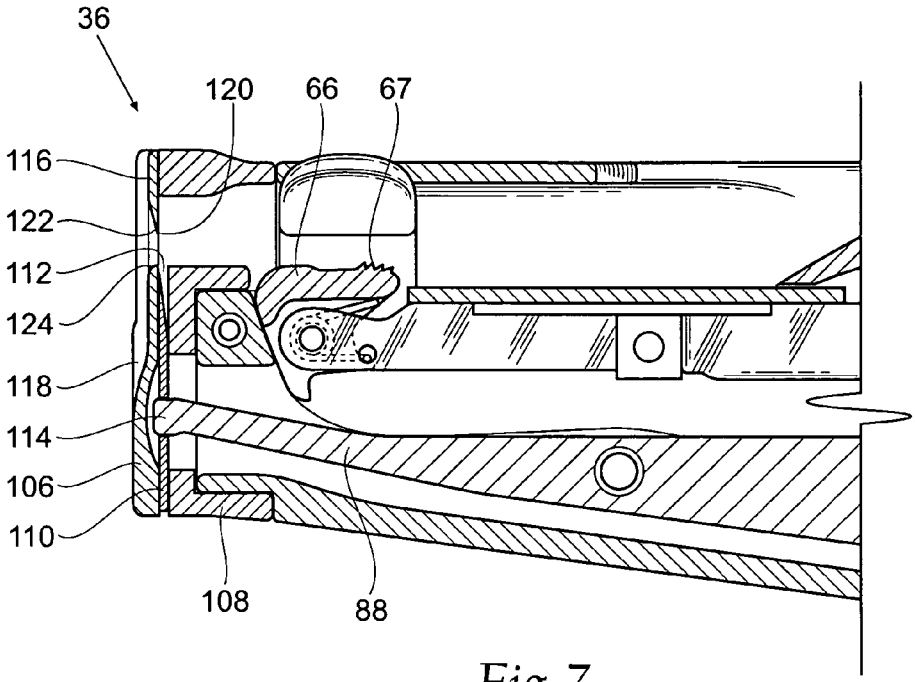
FIG. 7 is an enlarged cut-away partial front view of a nosepiece according to the present invention.

FIG. 7 shows an enlarged, cut away front view of the nosepiece 36. The nosepiece 36 provides reinforcement for the front of the tool 10, which assists the tool 10 in withstanding compressive forces developed when tensioning the cable tie 12. The nosepiece 36 has a front section 106 and a rear section 108, which are spaced apart from one another to allow a sharpened blade 110 to rest in a channel 112 formed by the sections 106 and 108. The blade 110 has a receiving slot 114 for inserting the blade link 88 into the blade 110. Thus, when the blade link 88 is moved as previously described with respect to FIGS. 3 and 4, the blade 110 will be moved upwardly to engage and sever the tail portion 18 of the cable tie 12 (not shown).

Figure 8:
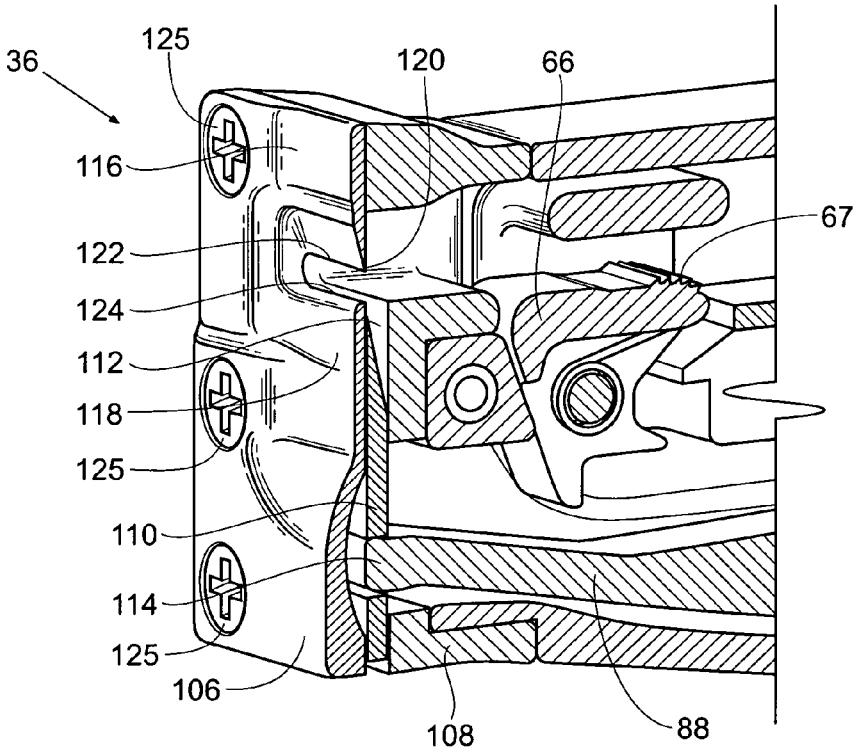
FIG. 8 is an enlarged cut-away partial perspective view of a nosepiece according to the present invention.

Referring to FIGS. 7 and 8, the nosepiece comprises an upper anvil 116 and a lower anvil 118 that form a cable tie entrance slot 120. The upper anvil has an upper edge 122, and the lower anvil 116 has a lower edge 124. The upper edge 122 is sharpened, which will supplement cutting of the cable tie 12. Preferably, the sharpened edge 122 is designed by using medical injection molding (MIM). The nosepiece 36 and sharpened edge 122 may be manufactured thicker than necessary and then be machined to achieve the desired sharpness and angle of the sharpened edge 122. The sharpened edge 122 is an advantage and improvement over prior cable tie tensioning tools.

The sharpened edge 122 was not practical in previous cable tool designs because previous nosepiece designs were cast iron or other similar cast metal. Previous designs were cast as a one-piece construction, or had the front section of the nosepiece fitted within the enclosed sides of the nosepiece, which prevented sharpening the edge of the casting. The present nosepiece arrangement allows for the desired sharpening of the front section 106, since it is not cast as a one-piece design, as much of the prior art was cast. Likewise, because front section 106 does not sit within the nosepiece, but is fastened together with screws or other fastening means 125, depicted in FIG. 8, onto the outside and not within the walls or edges of the nosepiece 36, it is possible to produce the desired sharpened edge 122 by specifically machining the front section 106 to specific dimensions, by die-casting the front section 106 and then cutting or removing excess material, or a combination of both processes. Prior art nosepiece designs did not allow for manufacturing of the noted sharpened edge with any of the above processes.

Referring to FIG. 8, the sharpened edge 122 is more evident, as is the ability for the sharpened blade 110 and the sharpened edge 122 to cooperate in severing a cable tie. The cooperation of the blade 110 and the edge 122 allows for a more efficient severing process. Furthermore, the arrangement reduces tension on the gripping mechanism 66, since the mechanism 66 and pawl 67 will not have to provide resistance to the cable tie for as long of a time as previous arrangements. This results in less wear and tear on the gripping mechanism 66, which means it needs to be replaced less frequently than prior severing tools. Thus, the present invention results in savings in time and money.

Figure 9:
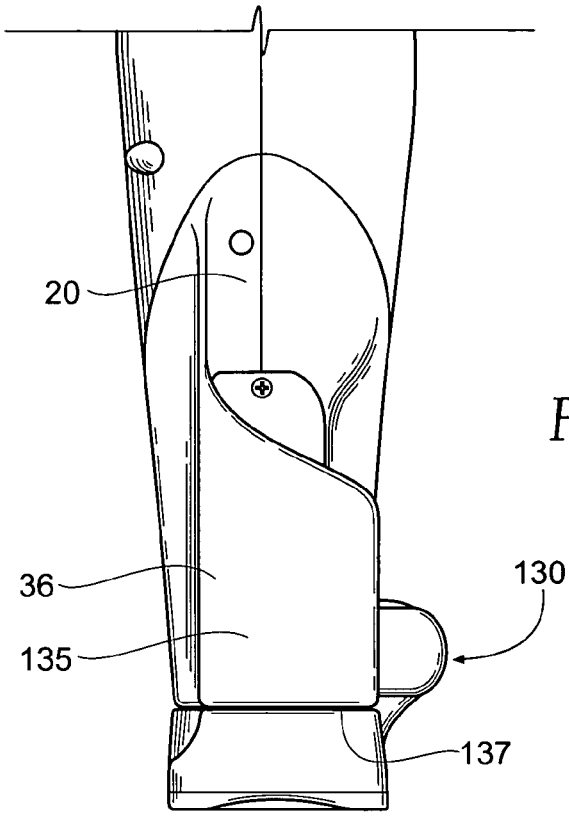
FIG. 9 is an enlarged partial top plan view of a nosepiece according to the present invention.

FIG. 9 is an overhead view of the nosepiece 36. A flange 130 is shown extending outwardly from the side of the nosepiece 36 and extending substantially outwardly from the housing 20, as well. Essentially, the flange 130 is wider than the width of the housing 20 and the nosepiece 36. The oversized flange 130 is an improvement over previous tool designs in that it allows for a more efficient feeding process of the cable tie 12 into the tie entrance 120 (see FIG. 10). For instance, the flange 130 provides a funnel effect for the entering cable tie 12, thereby easing the threading process for the operator.

Figure 10:
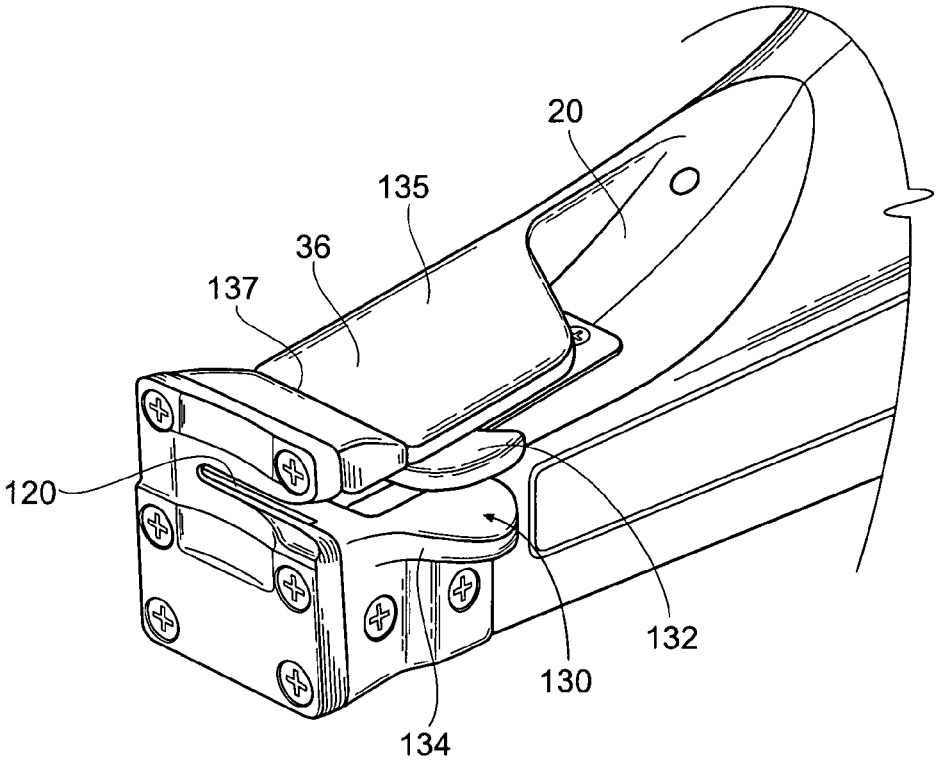
FIG. 10 is an enlarged partial perspective view of a nosepiece according to the present invention.

FIG. 10 is a perspective view of the nosepiece 36 and the flange 130. The flange 130 has a generally laterally extending top cast ledge 132 and a generally laterally extending bottom flange section 134 that assist in funneling the cable tie 12 properly within the nosepiece 36. Preferably, the bottom flange section 134 is machined as an integral piece with the nosepiece 36. The top cast ledge 132 and the bottom flange section 134 preferably have opposed curvate surfaces. That is, the top cast ledge 132 is angled upwardly and the bottom flange section 134 is angled downwardly to provide a funneling effect for the cable tie, which provides a quicker and more efficient operating system when compared to prior cable tie tools.

The flange 130 also has other advantages over the prior art. Previous designs only used a single upper member and not an upper and lower member. The use of both the top ledge 132 and the flange section 134 allows for the user to more easily feed the cable tie 12 into the nosepiece 36. Furthermore, it is desirable for the main body of a cable tie tool to be manufactured from a plastic material, which would be lighter and easier to manage for the operator. For instance a roof section 135 on the present tool 10 is preferably constructed from a plastic material. Because the roof section 135 and the nosepiece 36 are preferably constructed as separate pieces, most preferably since they are made from different materials, a small gap 137 will be located where the roof section 135 and the nosepiece 36 meet. Over time, as the tensioning mechanism 62 is moved, as described with respect to FIGS. 3 and 4, the stress and tension may increase the size of the gap 137. However, the design of the flange 130 and the top cast ledge 132 hides the gap 137, which prevents the gap 137 from becoming a pinch point for an inserted cable tie.

Prior art designs also have gaps as in the present invention, and further have another gap where a previously designed flange would be positioned next to the roof section. These gaps also become larger as the cable tie tools were used. However, prior flange designs did not compensate for these gaps. Thus, when a cable tie was fed into these tools, it was possible for the cable tie to bind up or get stuck in these gaps, which would lead to delays in the overall process. The newly designed flange on the present invention minimizes such problems, thereby increasing efficiency and productivity.

Figure 11:
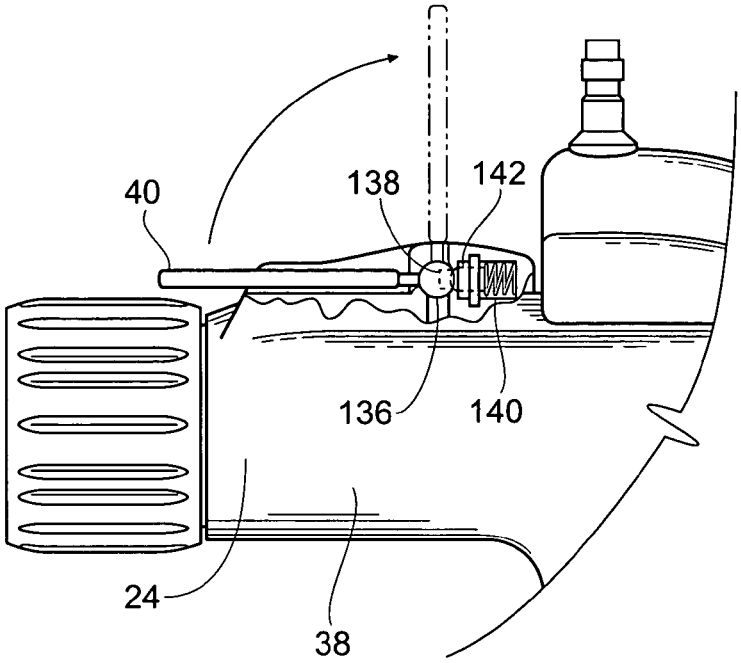
FIG. 11 is an enlarged partial side view of a hanging hook according to the present invention.

FIG. 11 is a side view of the rear section 38 of the barrel portion 24. The hook 40 is shown in a flat, stored position. Typically, the hook 40 allows the tool 10 to be supported by a spring-loaded overhead hanger support (not shown) that supports most of the weight of the tool 10. When not in use, the hook 40 can be secured in the position shown in FIG. 11. The hook 40 comprises a spherical ball 136 having at least one detent or bored out area 138 and preferably two detents 138. The detents 138 allow the hook 40 to be locked in predetermined positions. A spring 140 pushes up against a pin 142 located within the housing 20 and pushes the pin 142 into one of the detents 138 when properly arranged, thereby locking the hook 40 in one of the predetermined positions. Preferably the spring 140 and the pin 142 are a single, integral device. The hook 40 may be rotated upwards and may be locked into a further predetermined position.

Figure 12:
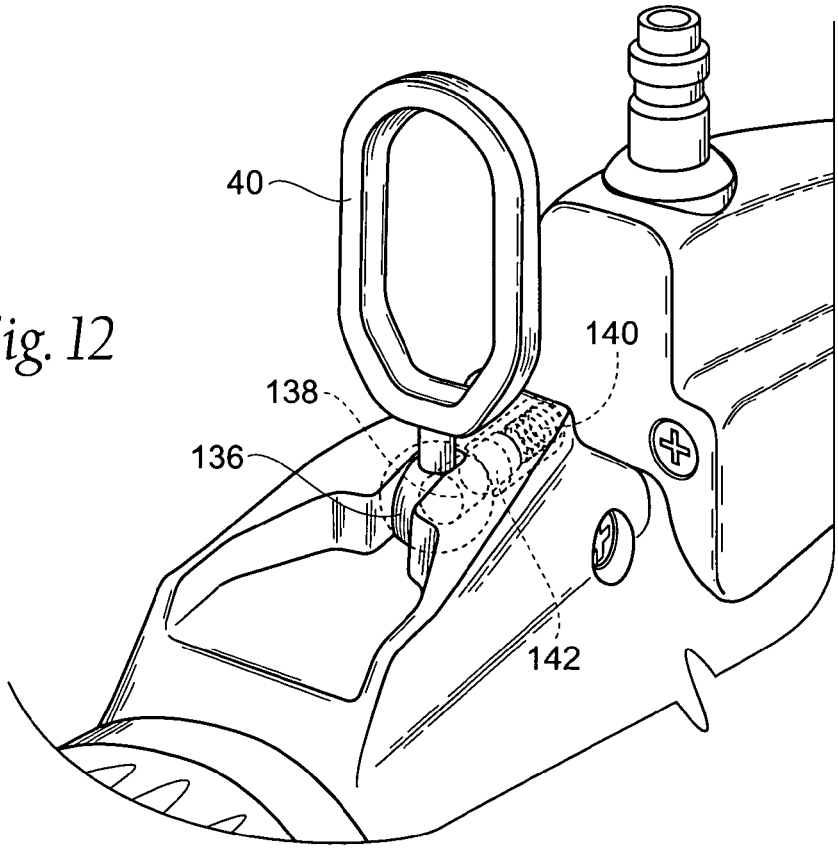
FIG. 12 is an enlarged partial perspective view of a hanging hook according to the present invention.

FIG. 12 shows a perspective view of the hook 40 in an extended position, which would be the preferred predetermined position for the tool 10 to be attached to an overhead hanger support. As noted, the spherical ball 136 may have another detent 138 arranged for the hook 40 to be locked in the shown extended position. While not necessary, the second detent 138 assists in the tool 10 being properly orientated when in use. The tension supplied to the hook 40 may be set to any desired tension by using springs of differing resistance. The hook arrangement in the present invention further provides a tool that is more ergonomically arranged versus prior cable tie tools.

The present invention provides an improved cable tie tool for both manufacture and the end user or operator. For instance, the adaptable air cylinder for use as an overhead or bottom air supply tool reduces the different components needed on hand during the assembly process. Because the remaining components of the tool are essentially the same, the manufacturer can produce a cable tool or cable tools quicker and more efficiently since there would be less downtime in ordering and waiting for specific tool components. In addition, fewer parts need to be stocked for service and maintenance of the tool.

Similarly, the present invention is much more user friendly for the end operator. None of the known relevant prior art allowed for or contemplated an overhead air supply for the cable tool. Because the tool will generally hang down from a ceiling, the overhead supply prevents the tool from twisting or hanging haphazardly as with previous tools. Likewise, it is more convenient for the hook and the overhead air supply to work in concert with one another to support and orientate the tool. The ability for the hook to lock in an opened or closed position further assists in proper orientation of the tool.

The improved cutting mechanism and the improved flange located on the nosepiece provide for a quicker and easier process, as well. When working at piecework or assembly line processes, this is significant, since even an improvement in time of a few seconds for each cable tie installation will add up over the course of a normal production shift. Similarly, the improved cutting mechanism will reduce stress on other elements of the tool, such as the gripping mechanism, which leads to less down time to service and replace parts on the tool.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A tool for tensioning and severing a cable tie used in connection with a remote pneumatic power supply, said cable tie including a head portion and a tail portion, said tool comprising:

a housing, said housing having a gripping portion and a barrel portion, said barrel portion having a front section and a rear section;

a nosepiece located on said front section of said barrel portion, said nosepiece having a cable tie entrance;

means for severing said cable tie;

a trigger for actuating said severing means;

a cylinder located within said housing and containing a piston for transmitting pneumatic power to said cable tool;

first and second spaced apart inlets, said first inlet being in communication with a first fitting having a portion thereof extending outwardly from a first location on said housing, and said first inlet being arranged for communication with said remote pneumatic power supply; and in the alternative, said second inlet being arranged for interchangeable entry and communication with a second fitting locatable on said housing at a second location spaced from said first location, and said second fitting having an outwardly extending portion arranged for communication with said remote pneumatic power supply.

2. A tool for tensioning and severing a cable tie used in connection with a remote pneumatic power supply, said cable tie including a head portion and a tail portion, said tool comprising:

a housing, said housing having a gripping portion and a barrel portion, said barrel portion having a front section and a rear section;

a nosepiece located on said front section of said barrel portion, said nosepiece having a cable tie entrance having a lower edge and an upper edge, said upper edge having a predetermined sharpness;

means for severing said cable tie, said severing means including said sharpened upper edge in severing cooperation with a retractable sharpened blade located in said nosepiece;

a fitting located on said housing, said fitting in communication with said pneumatic power supply and a cylinder;

said cylinder located within said barrel portion of housing, said cylinder transferring pneumatic power from said fitting to said cable tool, said cylinder being adaptable to receive said fitting in at least two predetermined positions, a trigger for actuating said severing means.

3. The cable tie tool according to claim 2, wherein said fitting is located on the top side of the barrel portion of the housing.

4. The cable tool according to claim 3, further comprising:

a pivotal hook located on the top side of said barrel portion, said pivotal hook including at least one detent for interacting with a spring-loaded pin located in said housing, said pin locking said hook in a predetermined position.

5. The cable tool according to claim 2, wherein said cylinder houses a pair of pistons, said pistons arranged in series with one another.

* * * * *